US007255074B2

(12) United States Patent
Han et al.

(10) Patent No.: US 7,255,074 B2
(45) Date of Patent: Aug. 14, 2007

(54) LINEAR EMV ACTUATOR USING PERMANENT MAGNET AND ELECTROMAGNET

(75) Inventors: Dong Chul Han, Seoul (KR); Hyeong Joon Ahn, Seoul (KR); Jee Uk Chang, Seoul (KR); Sang Yong Kwak, Seoul (KR)

(73) Assignee: Hyundai Motor Company, Seoul (KR)

( * ) Notice: Subject to any disclaimer, the term of this patent is extended or adjusted under 35 U.S.C. 154(b) by 10 days.

(21) Appl. No.: 11/302,083

(22) Filed: Dec. 12, 2005

(65) Prior Publication Data

US 2006/0130785 A1 Jun. 22, 2006

(30) Foreign Application Priority Data

Dec. 20, 2004 (KR) ..... 10-2004-0108850

(51) Int. Cl.
*F01L 9/04* (2006.01)

(52) U.S. Cl. ..... 123/90.11; 123/90.15; 251/129.01; 251/129.15

(58) Field of Classification Search ..... 123/90.11, 123/90.15; 251/129.01, 129.02, 129.15, 251/129.16

See application file for complete search history.

(56) References Cited

U.S. PATENT DOCUMENTS 6,216,653 B1 * 4/2001 Hara et al. ..... 123/90.11
6,634,327 B2 * 10/2003 Yanai ..... 123/90.11

* cited by examiner

*Primary Examiner*—Zelalem Eshete
(74) *Attorney, Agent, or Firm*—Morgan Lewis & Bockius LLP

(57) ABSTRACT

A linear EMV actuator uses a permanent magnet and an electromagnet in which EMV operation for opening/closing an exhaust valve and an intake valve makes valve operations linear. As a result, the valve undergoes a soft landing and active control of an amount of opening of the valve. The linear EMV actuator includes an upper core and a lower core, an armature, an actuator spring and a valve spring. Also included are a permanent magnet, an upper coil and a lower coil connected to each other in series thereby forming one electromagnet, a displacement sensor, and a position controller.

6 Claims, 6 Drawing Sheets

LINEAR EMV ACTUATOR USING PERMANENT MAGNET AND ELECTROMAGNET

CROSS-REFERENCE TO RELATED APPLICATION

This application claims priority to and the benefit of Korean Patent Application No. 10-2004-0108850 filed in the Korean Intellectual Property Office on Dec. 20, 2004, the entire contents of which are incorporated herein by reference.

BACKGROUND OF THE INVENTION (a) Field of the Invention

Generally, the present invention relates to a linear EMV actuator utilizing a permanent magnet and an electromagnet. More particularly, the linear EMV actuator operates to open and close an exhaust valve and an intake valve making valve operations linear so that the valve encounters a soft landing and active control of an amount of the opening of the valve.

(b) Description of the Related Art

Typically, a power generating apparatus, such as an engine, includes a valve and a device that opens and closes the valve. The valve typically functions to take air into a combustion chamber or for exhaust gas from the combustion chamber. Typically, a mechanical mechanism for driving the valve includes a crankshaft and a camshaft have been used to open and close the valve. More recently an EMV (Electro-Mechanical Valve train) valve driving method using electromagnetic operation has been developed as an alternative to the mechanical mechanism.

Two types of EMV actuators, an EMV using an electromagnet and an EMV actuator using a permanent magnet and an electromagnet are in use today.

The conventional EMV actuator that uses an electromagnet is described in Korean patent application No. 2002-0055972, and the conventional EMV actuator that uses a permanent magnet and an electromagnet is described in U.S. Pat. No. 4,779,582.

The EMV actuator using an electromagnet is configured such that a reciprocal motion of a valve is formed only by an electromagnet and a spring. That is, a first spring retainer is coupled to an upper portion of the valve and is supported by a valve spring. An armature is positioned at an upper end of the first spring retainer so as to be linearly movable. An upper coil and a lower coil are respectively disposed at an upper side and a lower side of the armature. A second spring retainer is connected to an upper portion of the armature while being elastically supported by an actuator spring. The EMV actuator using an electromagnet, current is alternately applied to the upper coil and the lower coil so that a driving force acts on the armature and thereby causes a vertically reciprocal movement of the valve.

The EMV actuator using a permanent magnet and an electromagnet together includes a valve stem and an armature that are integrally formed in order to produce a compulsory reciprocal motion of a valve. A permanent magnet is positioned outside the armature. In addition, an upper coil and a lower coil are respectively positioned above and below the permanent magnet. An actuator spring and a valve spring, for elastically supporting the armature are respectively positioned above and below the armature. Therefore, in the EMV actuator using a permanent magnet and an electromagnet, when current is alternately applied to the upper coil and the lower coil, a magnetic force is generated so that a position of the armature can be changed. Positive strengths of the actuator spring and the valve spring are similar to negative strengths due to the permanent magnet. Magnetic flux of the permanent magnet flows along the armature, the upper core, and the lower core. Since a negative strength due to the permanent magnet depending on a position of the armature increases as it approaches both ends, stable points of the armature are a center point and both end points.

That is, for an operation of the EMV actuator using a permanent magnet and an electromagnet, when the armature is position at one end, which is a stable point, current is applied to the opposite coil in order to move it to an opposite position. By repeating this, the armature can be reciprocally moved. Therefore, in the EMV using a permanent magnet and an electromagnet, current driving is needed only when a reciprocal motion is required in order to escape from stable points at both ends.

In the EMV actuator using only an electromagnet, since one valve is operated by respectively controlling two coils, i.e., upper and lower coils, there is a drawback in that many current controllers and displacement controllers are needed in the case where the engine has multiple cylinders. In addition, since an inductance and a magnetic force of a coil depending on a displacement of an armature are substantially nonlinear, a high-grade control strategy such as a nonlinear controller or an adaptive controller instead of a general linear controller is needed. In particular, great exertion is needed in order to realize a soft landing of a valve for avoiding problems cause by shocks on both ends of the valve. Furthermore, since initiation of movement is performed by using a resonance of a spring during initial driving of a valve, there are problems in that a time delay occurs and it is difficult to control an opening amount of a valve since the focus is on complete opening/closing of a valve.

In the EMV actuator using a permanent magnet and an electromagnet, since the strength of a spring and the negative strength of a permanent magnet are designed to be similar to each other, a substantial current is needed to obtain the speed of reciprocal motion of a valve that can be used in a real vehicle. In addition, in the EMV actuator using only an electromagnet, an upper coil and a lower coil are needed in order to control one valve, and there is a drawback of shocks on both ends of the valve. Further, although there is little problem in initial driving of a valve, it is difficult to freely control an opening amount of a valve, and although it has a better controllability than the EMV actuator using only an electromagnet, there is a drawback that controllability is limited because of a design of an actuator using nonlinearity.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a linear EMV using a permanent magnet and an electromagnet together, having the advantages of linearly controlling opening/closing operations of a valve via the permanent magnet and electromagnet. The operation enables a soft landing of a valve and an opening and closing amount of the valve is actively controlled.

An exemplary EMV actuator for opening/closing an intake valve and an exhaust valve of an engine according to an embodiment of the present invention includes a valve; an upper core and a lower core positioned above the valve. An armature is provided above the valve and extends toward an inside portion of the upper core and the lower core. An actuator spring and a valve spring are positioned above and below the valve and elastically support the armature such that the armature is positioned at a neutral point of the upper core and the lower core. A permanent magnet is positioned outside the armature and an upper coil and a lower coil are respectively disposed above and below the permanent magnet. The upper coil and the lower coil are connected to each other in series, thereby forming one electromagnet.

In some embodiments, a displacement sensor for measuring an amount of displacement of the armature is positioned above the upper core. A position controller for controlling an amount of current applied to the upper coil and the lower coil in order to control an amount of displacement of the armature measured by the displacement sensor is provided. The displacement sensor can be separately formed as a first sensor and a second sensor inside a cylindrical case formed outside the upper spring retainer in order to detect an amount of movement of an upper spring retainer supporting an end of the actuator spring.

In another embodiment, an EMV actuator for opening/closing an intake valve and an exhaust valve of an engine includes an upper core and a lower core. An armature is disposed between the upper core and the lower core and is extended toward an inside portion of the upper core and the lower core. A valve is disposed below the armature and an actuator spring and a valve spring are positioned above and below the armature so as to elastically support it. A permanent magnet is positioned outside the armature and an upper coil and a lower coil, respectively, are disposed above and below the permanent magnet and connected to each other in series, thereby forming one electromagnet. A displacement sensor is installed above the upper core and measures an amount of displacement of the armature. A position controller is included for controlling an amount of current applied to the upper coil and the lower coil in order to control an amount of displacement of the armature.

An upper spring retainer is supported by the actuator spring and can be positioned above the armature. The displacment sensor can include a cylindrical outer case positioned outside the upper spring retainer and a first sensor and a second sensor is separately positioned inside the cylindrical outer case for detecting an amount of displacement of the upper spring retainer.

A cylindrical upper case for containing an upper spring retainer is extruded above the upper core. The actuator spring and the displacement sensor can be provided above the upper core. A separate cap can be formed to be able to be assembled at an opened upper portion of the upper case. A stepped groove into which an outer case of the displacement sensor is inserted can be formed on an inner circumference of the upper case.

DETAILED DESCRIPTION OF THE EMBODIMENTS

Figure 1:
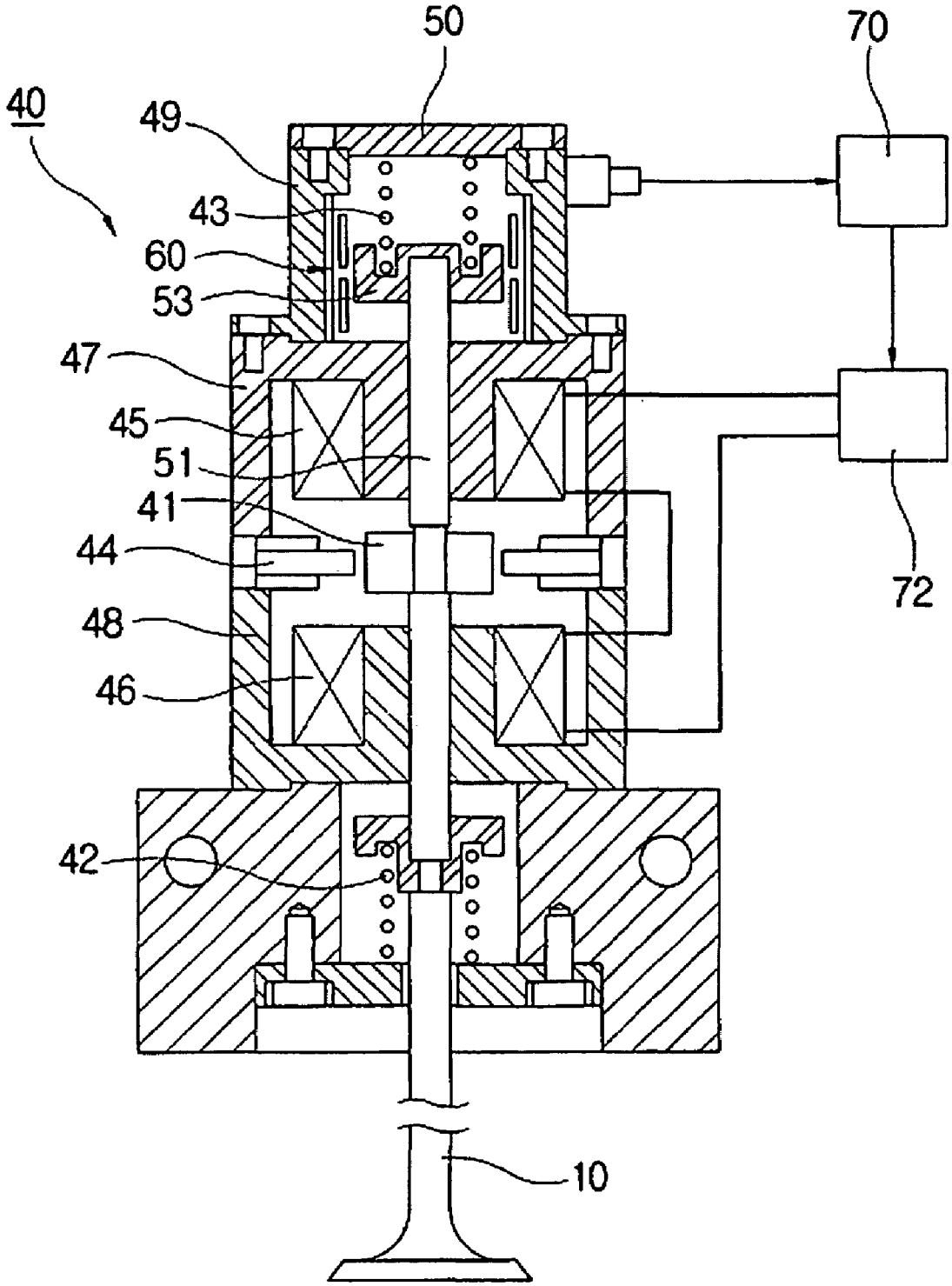
FIG. 1 is a schematic diagram of a linear EMV actuator according to an embodiment of the present invention.

Referring to FIG. 1, reference numeral 40 shows a linear EMV (Electro-Mechanical Valve train) actuator according to an embodiment of the present invention. Reference numeral 60 indicates a displacement sensor used for the linear EMV actuator according to an embodiment of the present invention. Linear EMV actuator 40 is a device that utilizes a permanent magnet and an electromagnet together for actuating valve 10 in linear movement, i.e., upward/downward directions in the Figure.

Linear EMV actuator 40 includes an armature 41 positioned at an upper end of valve 10. Actuator spring 43 maintains armature 41 in a neutral state against valve spring 42. A permanent magnet 44 is disposed outside armature 41 and an upper coil 45 and a lower coil 46, respectively, are disposed above and below permanent magnet 44. An upper core 47 and a lower core 48 house armature 41, permanent magnet 44, upper coil 45, and lower coil 46. A displacement sensor 60 is positioned above upper core 47. Displacement sensor 60 is configured to detect an amount of displacement of armature 41.

In some embodiments, upper coil 45 and lower coil 46 of linear EMV actuator 40 are connected to each other in series such that current can flow to both with one control system. That is, depending on a direction of supplied current, current may flow-to lower coil 46 via upper coil 45 or to upper coil 45 via lower coil 46, therefore, one electromagnet is formed through the two coils.

In addition, an upper spring retainer 53 for supporting a lower end of actuator spring 43 is coupled to an end of an upper rod 51 of armature 41 that extrudes over upper core 47. A cylindrical upper case 49, for housing upper spring retainer 53 and actuator spring 43 is mounted to an upper portion of upper core 47. According to an alternative embodiment, actuator spring 43 is fixedly mounted to an upper portion of upper core 47 by a bolt, welding, or the like.

Figure 2:
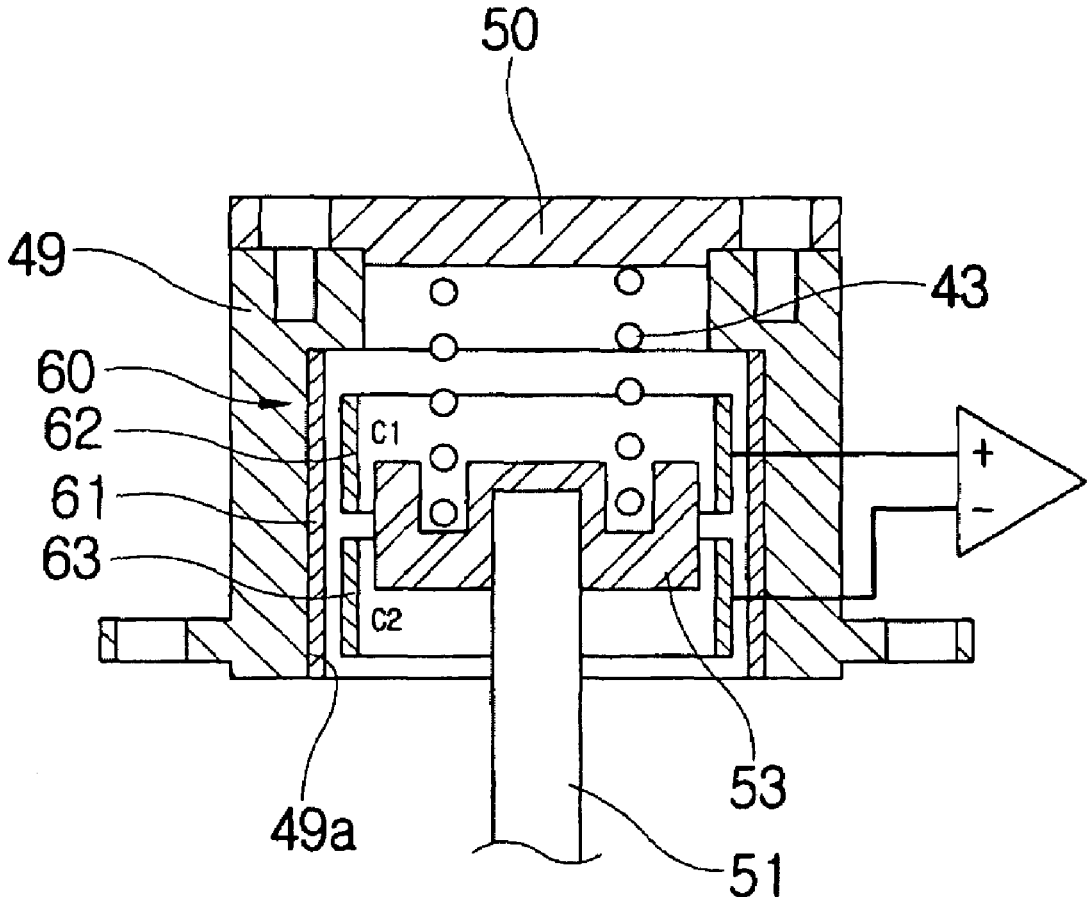
FIG. 2 is a schematic diagram of a sensor used for a linear EMV actuator according to an embodiment of the present invention.

Referring now to FIG. 2, a separate cap 50 covers an opened upper portion of upper case 49, and an upper end of actuator spring 43 is elastically supported by a lower surface of cap 50. A stepped groove 49*a*, into which outer case 61 of displacement sensor 60 is inserted, is formed on an inner circumference of upper case 49. The displacement sensor 60, mounted to upper case 49, is separately formed as a first sensor 62 and a second sensor 63 in order to detect movement of upper spring retainer 53 moving together with armature 41. According to an embodiment, first sensor 62 and second sensor 63 are formed in a shape of a pipe.

Displacement sensor 60 is positioned apart from upper spring retainer 53 by a predetermined gap. Displacement sensor 60 detects an amount of displacement of armature 41 based on a change of an amount of current transmitted from the upper spring retainer 53. Such displacement sensor 60 will be understood by one of ordinary skill in the art as sensor that is generally used in the art for measuring an amount of flow, therefore, a detailed description thereof will be omitted. In addition, in order to control an amount of movement of armature 41, a position controller 70, for controlling an amount of current applied to upper coil 45 and lower coil 46, is connected to a current controller 72 for supplying current to upper coil 45 and lower coil 46. In particular, if a level of current applied to the upper coil 45 and the lower coil 46 is varied by the control of the position controller 70, an amount of movement of the armature 41 can be controlled.

For such control operation, actuator spring 43 and valve spring 42 take a role of maintaining a position of armature 41 at a center position of upper core 47 and lower core 48. In addition, since a magnetic force generated by permanent magnet 44 is set to be less than an elastic force of actuator spring 43 and valve spring 42, permanent magnet 44 does not take a direct role in driving armature 41 but takes part in maintaining a position of armature 41 at a neutral state.

Figure 3:
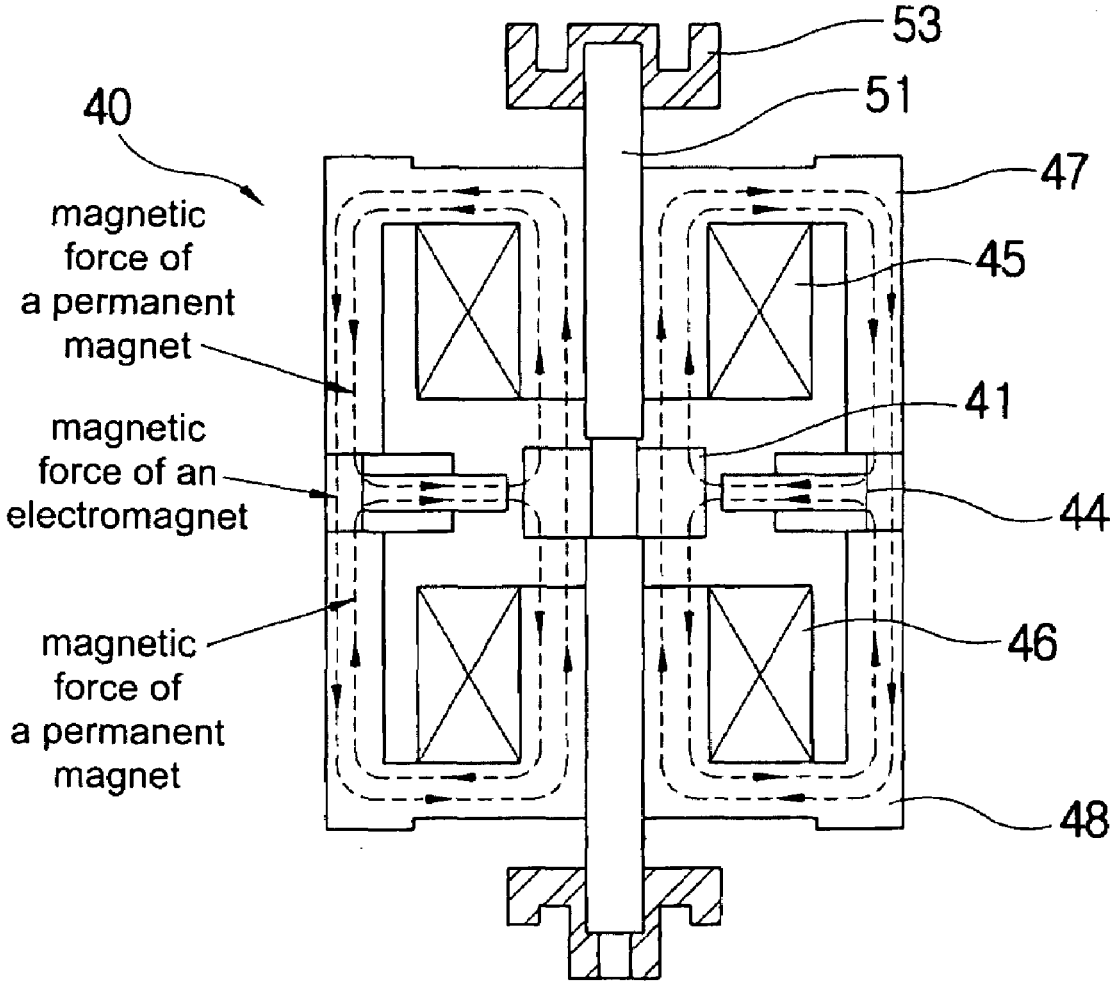
FIG. 3 is a drawing for explaining directions of electromagnetic force during a valve-open operation according to an embodiment of the present invention.
Figure 4:
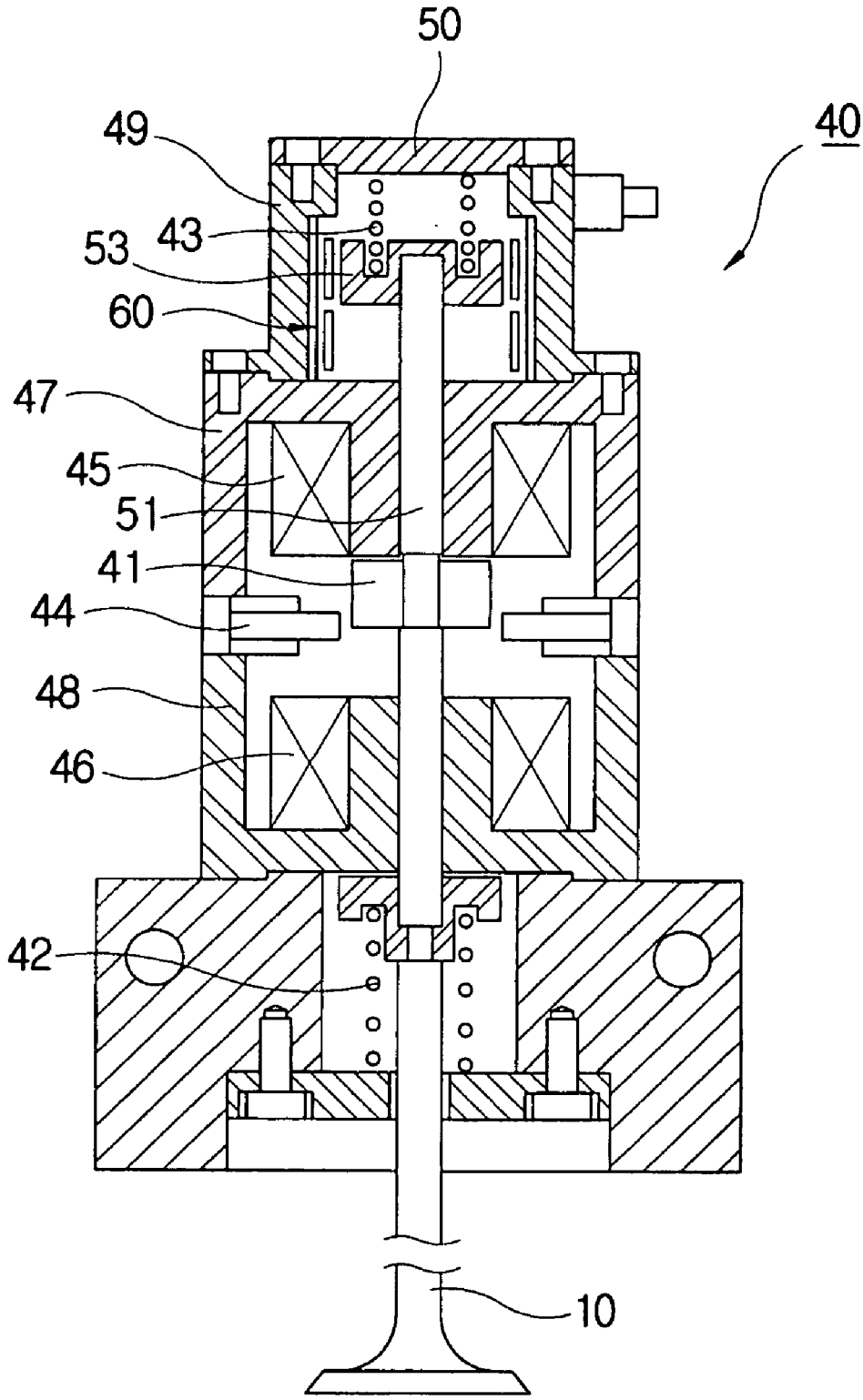
FIG. 4 shows an operation state of a linear EMV actuator during a valve-open operation according to an embodiment of the present invention.
Figure 5:
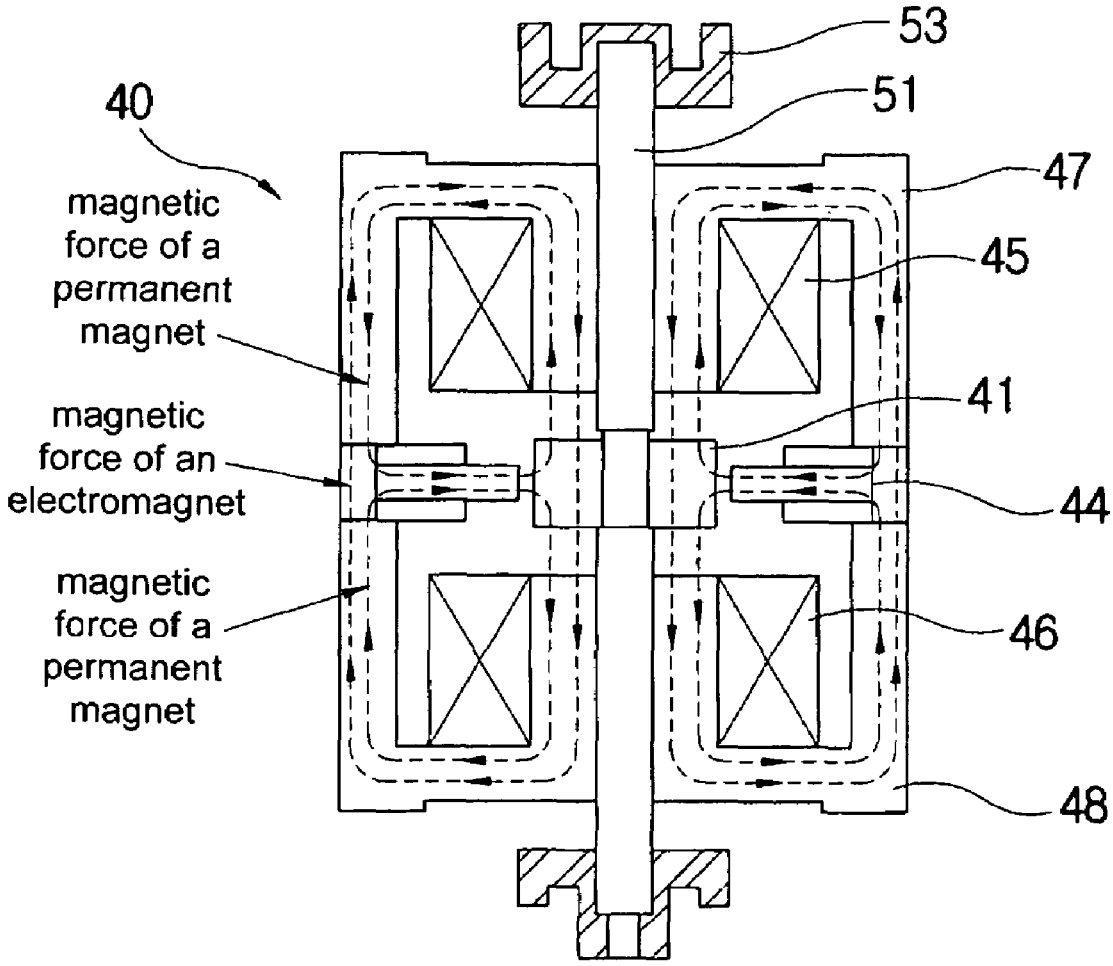
FIG. 5 is a drawing for explaining directions of electromagnetic force during a valve-close operation according to an embodiment of the present invention.
Figure 6:
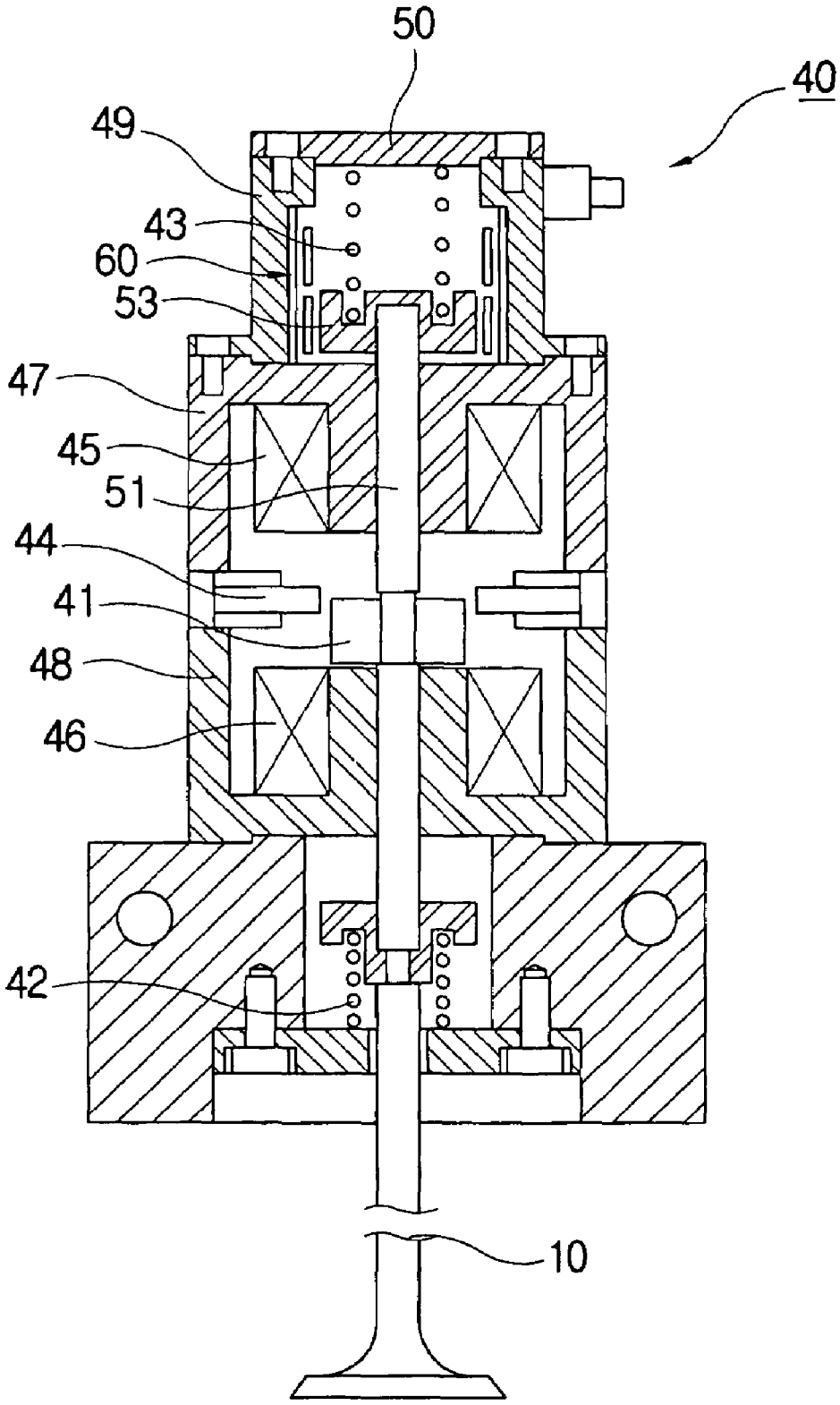
FIG. 6 shows an operation state of a linear EMV actuator during a valve-close operation according to an embodiment of the present invention.

As shown in FIGS. 3 and 5, the electric field is formed as a closed curve in a direction toward an inner portion of permanent magnet 44 from an outer portion thereof. The electric field of upper coil 45 and lower coil 46 is formed as a closed curve depending on the direction of current applied. If the direction of current is changed, the direction of the electromagnetic field generated by the electromagnet is oppositely changed, but the direction of the electric field generated by the permanent magnet does not change. Therefore, when the direction of the electric field caused by the electromagnet is the same as the direction of the electric field caused by permanent magnet 44, a magnetic force acting on armature 41 is increased so that armature 41 can move. On the other hand, when the direction of the electric field caused by the electromagnet is opposite to that of the electric field caused by permanent magnet 44, the magnetic force is decreased so that a movement of armature 41 is dominated by a magnetic force of the opposite side. Since a direction of current flowing to upper coil 45 and lower coil 46 is changed in the above-mentioned method and a level of current applied to upper coil 45 and lower coil 46 is controlled by position controller 70, linear and gradual actuating of valve 10 is achieved.

In particular, since only one electromagnet is used for one valve, an electric control apparatus for forming the valve actuating device may become simple, inductance thereof rarely changes with respect to a position of the valve, and initial driving when starting an engine is possible.

According to linear EMV actuator 40, since only one electromagnet is needed for one valve of an engine, an electric control apparatus for forming the valve actuating device may become simple. Further, since the valve is actuated linearly and gradually, it is easy to control an amount of valve opening and responsiveness of the valve in response to operating conditions of an engine can be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A linear EMV actuator for opening/closing an intake valve and an exhaust valve of an engine, comprising:

a valve;

an upper core and a lower core positioned above the valve;

an armature positioned above the valve and extended toward an inside portion of the upper core and the lower core;

an actuator spring and a valve spring positioned above and below the valve and elastically supporting the armature such that the armature is positioned at a neutral point of the upper core and the lower core;

a permanent magnet positioned outside the armature;

an upper coil and a lower coil respectively disposed above and below the permanent magnet, wherein the upper coil and the lower coil are connected to each other in series thereby forming one electromagnet;

a displacement sensor for measuring an amount of displacement of the armature positioned above the upper core;

a position controller for controlling an amount of current applied to the upper coil and the lower coil in order to control an amount of displacement of the armature measured by the displacement sensor;

a cylindrical upper case for containing an upper spring retainer extruded above the upper core, the actuator spring, and the displacement sensor, wherein the cylindrical upper case is provided above the upper core; and a stepped groove into which an outer case of the displacement sensor is inserted, formed on an inner circumference of the upper case.

2. The linear EMV actuator of claim 1, wherein the displacement sensor is separately formed as a first sensor and a second sensor inside a cylindrical case formed outside the upper spring retainer in order to detect an amount of movement of an upper spring retainer supporting an end of the actuator spring.

3. The linear EMV actuator of claim 1, further comprising: a separate cap configured to be assembled at an opened upper portion of the upper case.

4. A linear EMV actuator for opening/closing an intake valve and an exhaust valve of an engine, comprising:

an upper core and a lower core;

an armature disposed between the upper core and the lower core, the armature extended toward an inside portion of the upper core and the lower core;

a valve disposed below the armature;

an actuator spring and a valve spring positioned above and below the armature so as to elastically support the armature;

a permanent magnet positioned outside the armature;

an upper coil and a lower coil respectively disposed above and below the permanent magnet and connected to each other in series, thereby forming one electromagnet;

a displacement sensor installed above the upper core and configured to measure an amount of displacement of the armature;

a position controller for controlling an amount of current applied to the upper coil and the lower coil in order to control an amount of displacement of the armature;

a cylindrical upper case positioned above the upper core for containing an upper spring retainer extending above the upper core, the actuator spring, and the displacement sensor; and a stepped groove, formed on an inner circumference of the upper case, into which an outer case of the displacement sensor is inserted.

5. The linear EMV of claim 4, further comprising:

an upper spring retainer supported by the actuator spring, the upper spring retainer being positioned above the armature; and a displacement sensor comprising a cylindrical outer case positioned outside the upper spring retainer and a first sensor and a second sensor separately positioned inside the cylindrical outer case, wherein the displacement sensor detects an amount of displacement of the upper spring retainer.

6. The linear EMV of claim 4, further comprising: a separate cap configured at an opened upper portion of the upper case.

* * * * *